US006290093B1

(12) United States Patent
Obriot et al.

(10) Patent No.: US 6,290,093 B1
(45) **Date of Patent: *Sep. 18, 2001**

(54) DEVICE FOR LOCKING THE COVER OF A CONTAINER, AND CONTAINER SO EQUIPPED

(75) Inventors: Denis Obriot, Heuilley-Cotton; Emmanuel Brazier, Langres, both of (FR)

(73) Assignee: Compagnie Plastic Omnium, Lyons (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/062,420

(22) Filed: Apr. 17, 1998

(30) Foreign Application Priority Data

Apr. 17, 1997 (FR) ..... 97 04746

(51) Int. Cl.[7] ..... B65D 55/02; B65D 43/22

(52) U.S. Cl. ..... 220/835; 220/324; 220/908; 292/230; 292/236

(58) Field of Search ..... 220/210, 324, 220/326, 260, 833–835, 908, 828; 70/163, 166, 168, 139, 47; 49/379; 292/230, 231, 236, 238, DIG. 11

(56) References Cited

U.S. PATENT DOCUMENTS

| | | | | |
|---|---|---|---|---|
| 5,085,341 | * | 2/1992 | Hodge | 220/908 X |
| 5,149,153 | * | 9/1992 | Drewry et al. | 220/908 X |
| 5,224,744 | * | 7/1993 | Michelutti | 220/908 X |
| 5,329,865 | * | 7/1994 | McWard | 70/159 X |
| 5,772,264 | * | 6/1998 | Bettenhausen | 292/230 X |
| 5,860,302 | * | 1/1999 | James | 70/168 X |

FOREIGN PATENT DOCUMENTS

| | | |
|---|---|---|
| 296 04 340 | 6/1996 | (DE) . |
| 295 11 098 | 12/1996 | (DE) . |
| 2721912 | 1/1996 | (FR) . |

* cited by examiner

*Primary Examiner*—Nathan J. Newhouse
(74) *Attorney, Agent, or Firm*—Baker Botts

(57) ABSTRACT

A locking mechanism (7) for the cover (2) of a container (1), especially a garbage can or dumpster, that is emptied by tilting. The mechanism (7) includes a pivoting part (10) pivotably mounted on the cover (2) of the container (1). When the container (1) is tilted, the pivoting part (10) moves from a locked position to an unlocked position by force of gravity. The pivoting part (10) includes a lower arm (13) capable of engaging a catch member such as a lug (16) when the cover (2) is closed and when the pivoting part is in a position to lock the cover. The invention further relates to a container (1) equipped with such a locking mechanism (7).

14 Claims, 4 Drawing Sheets

DEVICE FOR LOCKING THE COVER OF A CONTAINER, AND CONTAINER SO EQUIPPED

BACKGROUND OF INVENTION

1. Field of the Invention

The present invention relates to a device for locking the cover of a container intended to be emptied by tilting more than 90°, such as a garbage can or dumpster for waste collection.

2. Description of the Related Art

As is known, dumpsters for waste collection tend to remain periodically on the public right-of-way, to be emptied by tilting into a collecting vehicle. The dumpsters are then left unattended, and it may happen that they will be picked over. This may be dangerous, depending on the kind of waste contained in them.

Moreover, free access to the interior of the dumpsters may enable third parties to fill them with unsuitable waste, thereby possibly denaturing the contents in the case of selective collection, or adding to the user's expense if the collection is charged for.

Locking devices for locking the cover of the dumpster when it is upright and waiting to be emptied, and unlocking it when it is being emptied, have already been proposed to solve these problems. For example, French Patent No. 2 721 912 to the assignee describes a locking device comprising a pivoting part pivotably mounted on the dumpster body inside a protective casing. When the container is upright, this pivoting part assumes a locked position in which it keeps the cover in closed position. When the container is tilted for emptying, the pivoting part, by force of gravity, moves from its locked position to an unlocked position.

Also, German Utility Model No. 295 11 098 U discloses a device for locking the cover of a container, comprising a pivoting part directly engaging the plastic of the upper rim of the container, which may cause wear. In addition, this prior art device comprises unlocking means attached to the cover, so that it is exposed to major impacts when the cover is opened or closed. Furthermore, the pivoting part comprises an upper arm and a lower arm, and the unlocking means comprises a key mechanism either pulling on the upper arm or resting on the lower arm near the geometrical axis of rotation of the pivoting part. In either case, the force exerted on the pivoting part is rather great, making the key mechanism rather difficult to operate.

SUMMARY OF THE INVENTION

The object of the present invention is to further improve the means of locking the cover of a container, of the type comprising a pivoting part pivotably mounted on the cover between a locked position, in which the cover is kept in closed position when the container is erect, and an unlocked position, in which the cover is released, the pivoting part moving from its locked position to its unlocked position by the force of gravity when the container is tilted.

This object is accomplished because the pivoting part comprises a lower arm capable of engaging a catch member, such as a lug, for example, when the cover is closed and when the pivoting part is in a position to lock the cover. According to the invention, because the pivoting part is mounted on the cover of the container, the pivoting part is less exposed to the waste while the dumpster is being filled. Thus, it is not necessary to house it in a protective casing, as was done with the device described in French Patent 2 721 912, supra. The result is an increase of space in the dumpster container and a lower cost of producing the locking device.

Furthermore, according to the invention, the pivoting part does not come into direct contact with the plastic of the container body, but contacts the catch member so that it does not cause wear. The catch member may be operated by a key mechanism and retracted by actuating the key mechanism to disengage from a hole in the pivoting part. Thus, the pivoting part may be unlocked without exerting much force on the catch member, and the key mechanism can be operated with relative ease. As a variant, the locking means comprises a mechanism consisting of a member pushing back the lower arm of the pivoting part when the user actuates a key.

In a preferred embodiment of the invention, the pivoting part is pivotably mounted about a geometrical axis of rotation parallel to the geometrical axis of tilt on which the container is emptied. This arrangement uses the movement of the container as a whole when it is being emptied, which helps the pivoting part to reach its position unlocking the cover.

As a comparison, in the device described in French Patent 2 721 912, the pivoting part is pivotably mounted about a geometrical axis of rotation perpendicular to the geometrical axis of tilt. In order to ensure dependable operation when emptying, a weight with some play is provided, for example, in a cavity of the pivoting part, to create a boost when the container is tilted and help it reach the unlocked position.

Continuing with a preferred embodiment of the invention, the pivoting part is connected to the cover substantially in the middle of the side of the cover opposing the articulating hinges.

In another preferred embodiment of the invention, the pivoting part comprises, in addition to the lower arm, an upper arm that extends into the interior volume of the cover.

The locking device according to the invention can readily be installed on an existing container.

Preferably, the device further comprises, on the interior side of the container, a protective wall or frame generally U-shaped in cross-section, whose arms are fixed to the inside wall of the container on either side of the catch member, the protective frame defining a housing open to the top and to the bottom. Because of this protective frame, the waste does not interfere with the unlocking of the lower arm.

The invention further relates to a dumpster for collecting waste, comprising locking means as aforesaid.

BRIEF DESCRIPTION OF THE DRAWINGS

Other features and advantages of the invention will appear from reading the detailed description which follows and the two non-limiting embodiments of the invention, and from examining the accompanying drawings, in which.

DETAILED DESCRIPTION OF THE INVENTION

Figure 1:
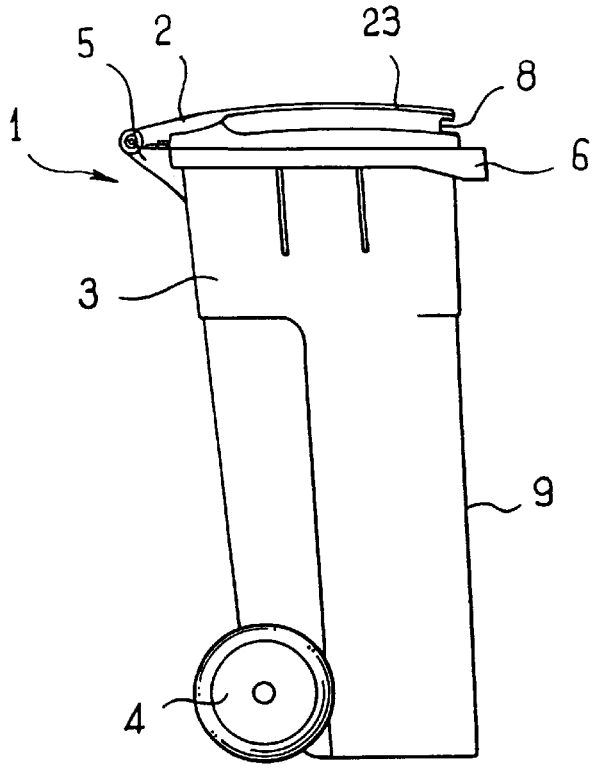
FIG. 1 is a schematic side view of a dumpster equipped with a locking device according to the invention.

The rolling container 1 shown in FIG. 1 comprises a body 3 of plastic material and a cover 2, also of plastic, joined to the body 3 by means of hinges 5 in a known manner. The cover 2 may be equipped with an opening for selective collection of glass or paper, for example.

In the non-limiting example shown, the container 1 comprises at the bottom, on the same side of the body 3 as the hinges 5, a pair of wheels 4 that rotates about a geometrical axis parallel to the geometrical axis of articulation (hinging) of the cover 2. It will be understood that other types of rolling containers, in particular containers of large capacity comprising, for example, four wheels, are not beyond the scope of the present invention. The wall of the container body 3, located opposite from the hinges 5 and wheels 4, will henceforth bear the reference 9.

The body 3 comprises in its upper portion an outer rim 6, on the side opposite from the hinges 5, defining a channel open downward for engagement by suitable hoisting means of a collection vehicle. These hoisting means, known in the art, are arranged to lift the container and empty it after tilting it to the right in FIG. 1, on a substantially horizontal axis of tilt parallel to the geometrical axis of articulation of the cover 2. The cover 2 comprises a slightly convex top wall 23, extended below at its periphery by a sealing skirt 8 borne by its lower edge resting on the rim 6 of the body 3 when the dumpster is closed.

Figure 2:
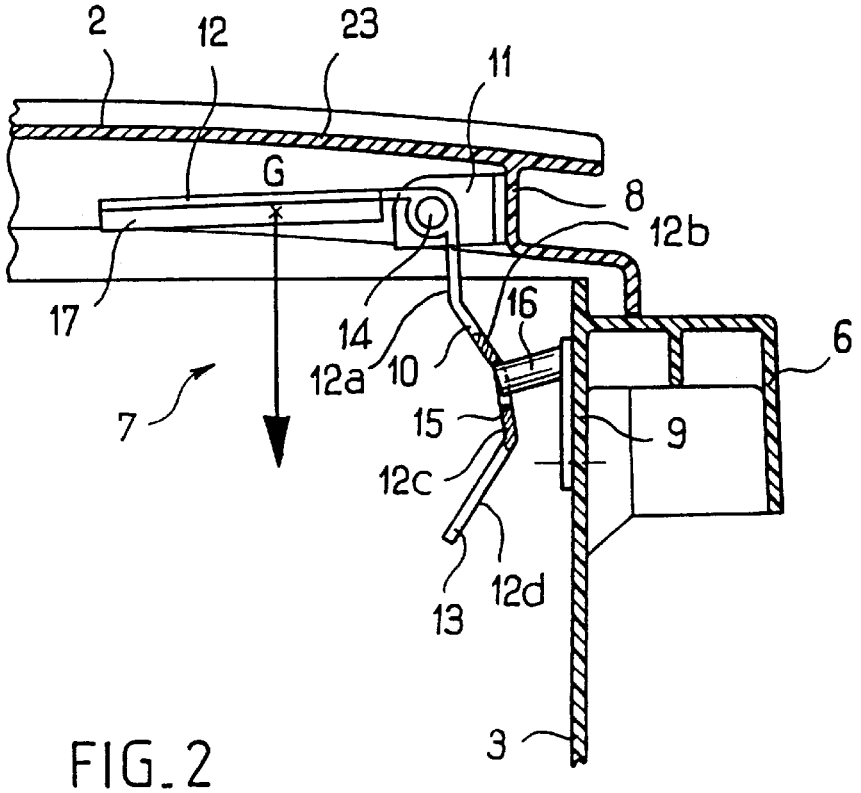
FIG. 2 is a schematic cross-section showing a locking means according to a first embodiment of the invention.

A locking means 7, according to a first embodiment of the invention and shown in FIG. 2, is mounted inside of the container 1. This locking means 7 comprises a pivoting part 10 connected to an angle foot 11 which serves as a pedestal, fixed by its base substantially in the middle of the side of the skirt 8 located opposite from the hinges 5. The foot 11 is so oriented in relation to the skirt 8 of the cover 2 that the geometrical axis of articulation of the pivoting part 10 is parallel to the geometrical axis of articulation of the cover 2.

The pivoting part 10 comprises an upper arm 12 and a lower arm 13 joined to make a right angle about a hub 14. The upper arm 12 is rectilinear and extends under the wall 23 into the interior volume of the cover 2.

The lower arm 13 is made up of four consecutive rectilinear segments 12*a*, 12*b*, 12*c* and 12*d*. Segment 12*a*, nearest to the upper arm 12, is perpendicular to the latter. Continuing down the lower arm 13, the next three segments 12*b*, 12*c*, and 12*d* describe substantially half of a hexagon whose concavity faces the interior of the body 3. The second segment from the bottom, 12*c*, is traversed by a hole 15 in which a catch member may be inserted when the cover 2 is closed. As described in this embodiment, this catch member consists of a lug 16 fixed to the inner surface of the wall 9, substantially at the same height as the rim 6.

As will be noted upon examining FIG. 2, this lug 16 is lightly inclined towards the bottom of the body 3, the better to retain the lower arm 13. In the example shown in the figures, the lug 16 is cylindrical. In a modification not shown, the lug 16 is flat and made by cutting and folding an electrogalvanized sheet.

The upper arm 12 is integral with a block 17, which may be made in one piece with the rest of the pivoting part 10 in the form of a bend, for example, or, as a variant, be formed as a compound part. The angular swing of the upper arm 12 under the cover 2, approaching the wall 23, is enough to permit the pivoting part 10 to rotate as required to disengage the hole 15 in the lower arm 13 from the lug 16.

The letter G is used to mark the location of the center of gravity of the pivoting part 10, and the resultant force exerted upon it by gravity is indicated by an arrow. It will be understood that this force, when the container rests upright on its base with the cover 2 closed, creates a torque tending to hold the pivoting part 10 in locked position in cover 2, that is, with the lug 16 engaged in the hole 15. The lower segment 12*d* of the lower arm 13 extends obliquely towards the interior of the body, so as to slide on the end of the lug 16 when the cover is swung back on the body, to permit engagement of the lug 16 in the hole 15.

Figure 3:
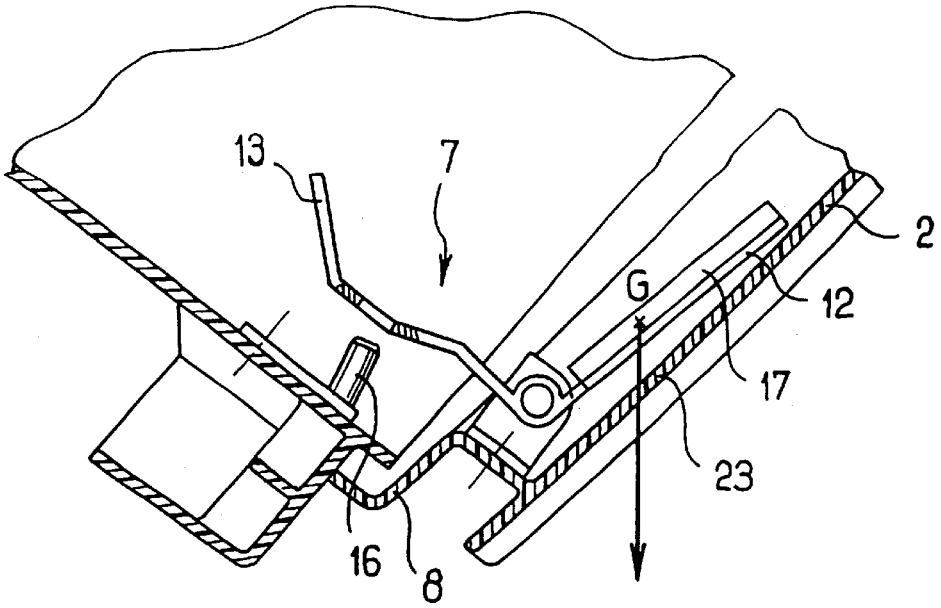
FIGS. 3 and 4 illustrate the operation of the device shown in FIG. 1, when the container is emptied.
Figure 4:
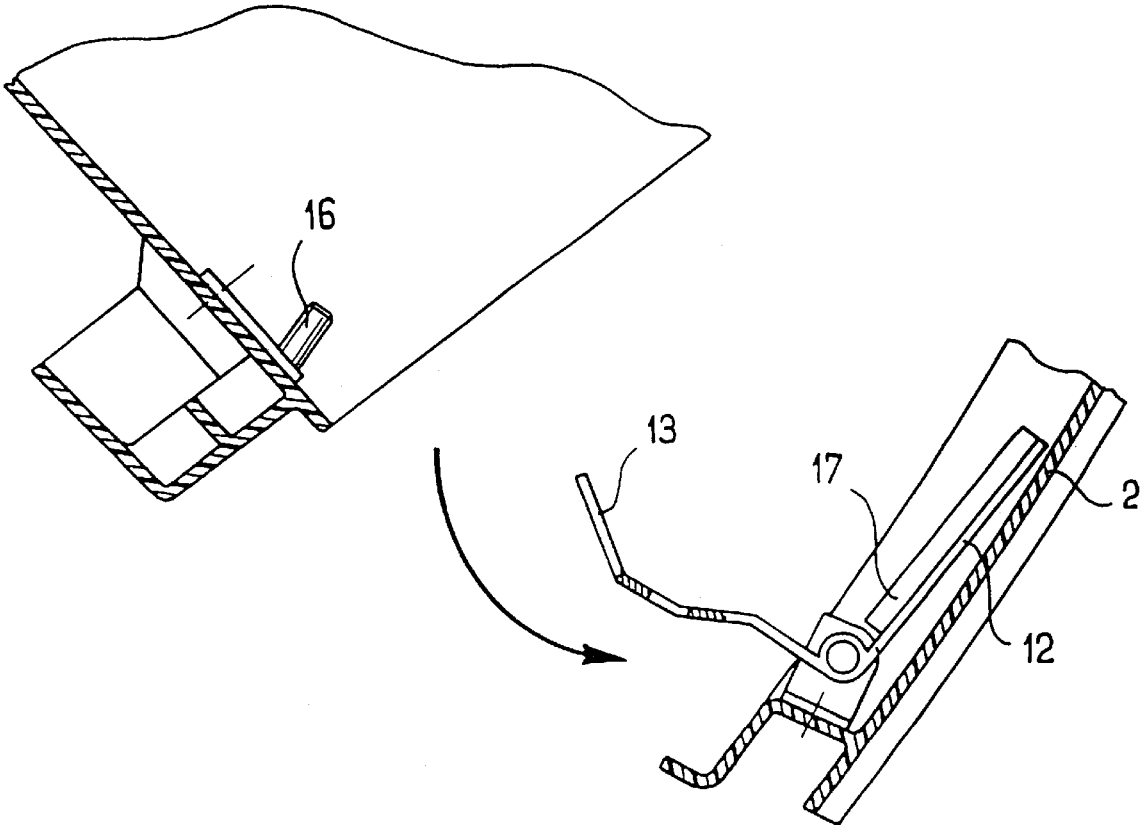

In FIG. 3, the locking means 7 is represented, after the container is tilted and after the vertical line passing through the center of gravity G of the pivoting part 10 has passed the vertical plane containing the geometrical axis of articulation of the pivoting part 10 on the cover 2. This tilting generates a torque tending to drive the pivoting part 10 rotationally towards the unlocked position of cover 2. In this figure, the lower arm 13 is shown already disengaged from the lug 16, and the upper arm 12 is shown resting against the inner face of the wall 23 of the cover 2. Thus unlocked, the cover 2 is free to open under the force of gravity as shown in FIG. 4.

Figure 5:
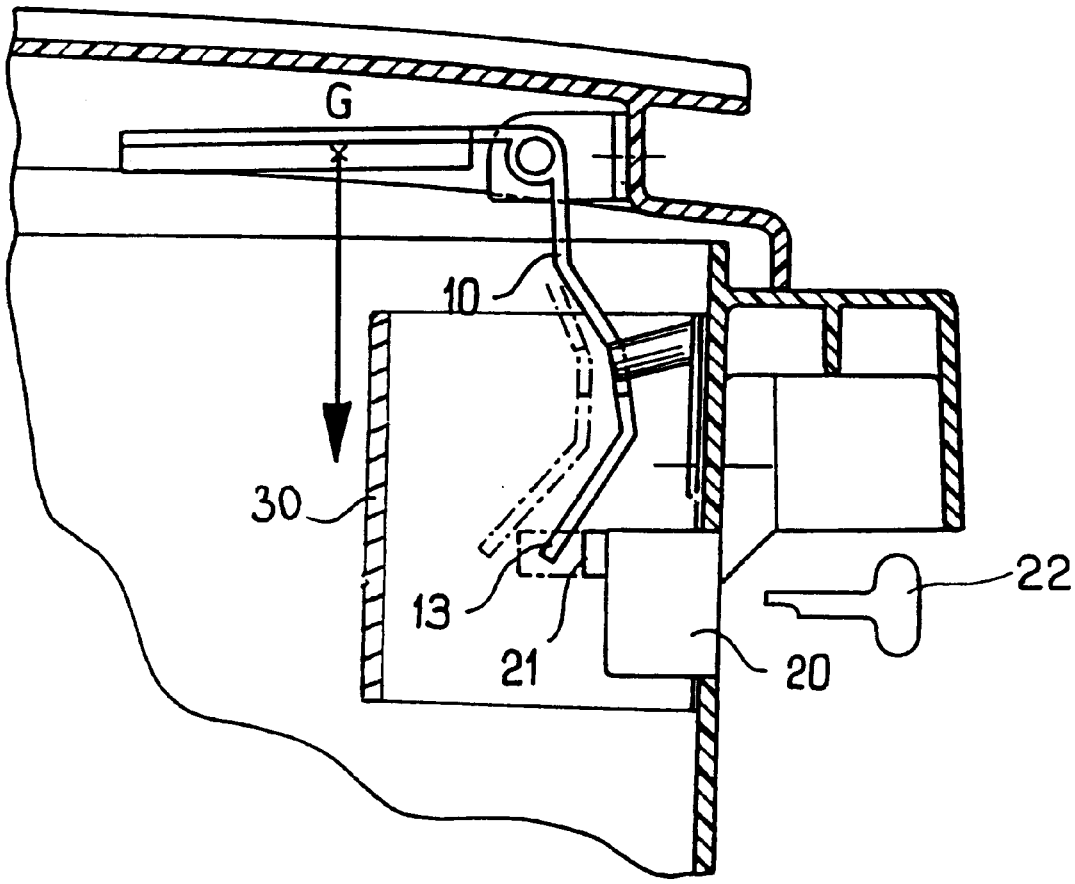
FIG. 5 is a view similar to that of FIG. 2, showing a locking means according to a second embodiment of the invention.

FIG. 5 shows a second embodiment of the device according to the invention. This embodiment differs from the preceding one in that a means is provided to enable the user to unlock the cover 2 when the body 3 rests erect on its base. In this example, the cover 2 is not provided with any opening for selective collection.

The aforesaid unlocking means consists, for example, of a mechanism 20 comprising a member 21 thrusting back the lower arm 13 near its free end when the user actuates a key 22 introduced into the mechanism 20. In dashed lines, FIG. 5 shows the position taken by the member 21 and by the lower arm 13 when the cover is unlocked.

Figure 6:
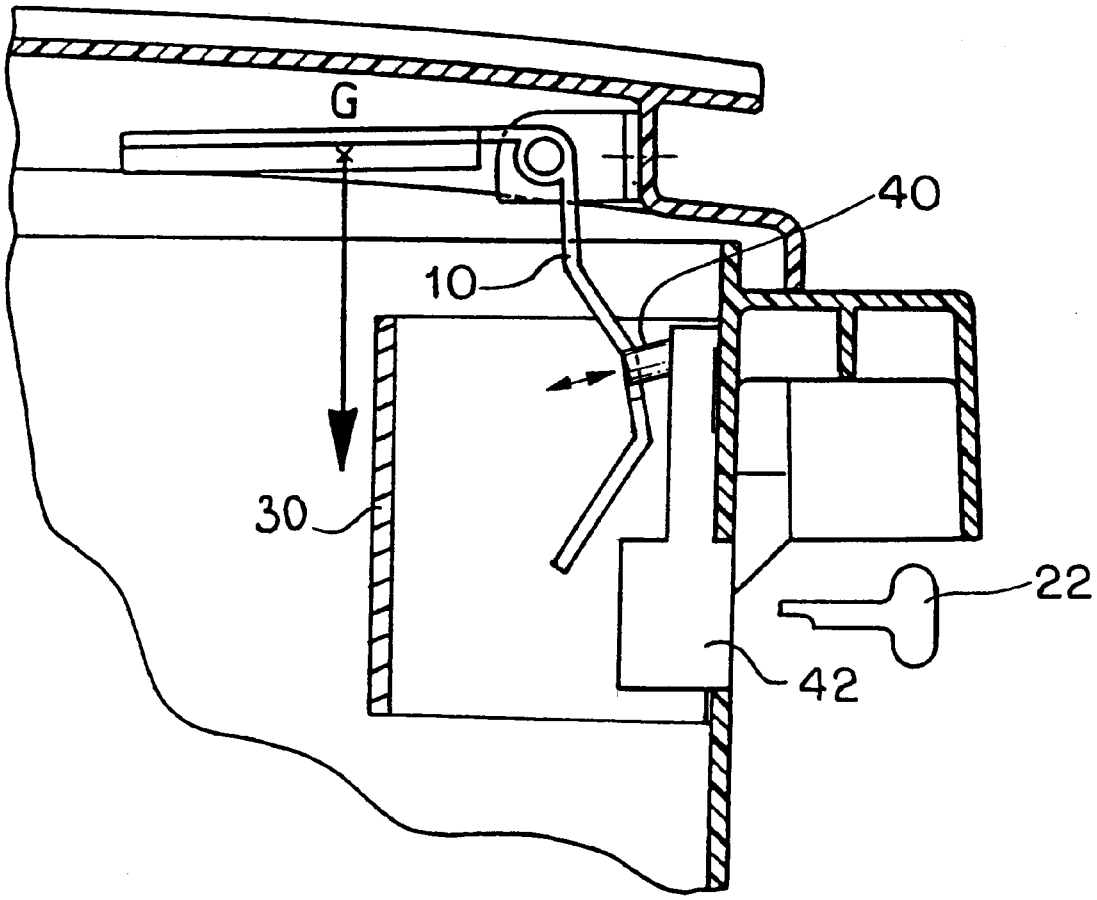
FIG. 6 is a view similar to FIG. 5 showing a keying activated locking mechanism according to another embodiment of the invention.

Of course, without departing from the scope of the present invention, other means might be provided to enable the user to unlock the cover 2. Thus, through the wall 9 of the body 3, one could make a hole having a particular outline, enabling the user to introduce a member of matching cross-section to push the lower arm 13 enough to release the cover 2. Also, the lug 16 may be 40 actuated by a key mechanism 42 and retracted when key 22 is activated, as shown in FIG. 6, to disengage the lower arm 13 from the hole 15 and release it.

In addition, a protective wall or frame 30, of generally U-shaped cross-section, might be placed on the inside wall of the body, the arms of the frame fixed to the wall of the body on either side of the lug 16.

The protective frame 30 is dimensioned and positioned on the body so as to be wide open to the top and to the bottom, which keeps bits of waste from being caught inside of it. The frame 30 prevents waste from blocking the lower arm while in locked position.

We claim:

1. A container for collecting waste, comprising a body, a cover, articulated on said body, and a device for locking the cover on the body, said device comprising:

a lug fixed on the body of the container; and a pivoting part pivotably mounted on the cover of said container, said pivoting part comprising a lower arm capable of engaging said lug when said cover is closed;

said pivoting part moving between a locked position, in which said pivoting part keeps said cover in a closed position when said container is upright, and an unlocked position, in which said pivoting part releases said cover, said pivoting part moving from its locked position to its unlocked position by force of gravity when said container is tilted and said pivoting part having an upper portion which is accessible from the inside of the container to move said pivoting part to the unlocked position, and said cover and said body being free of structure that obstructs a downwardly facing surface of said upper portion of said pivoting part.

2. The container according to claim 1, wherein said pivoting part pivots about a geometrical axis of rotation parallel to a geometrical axis of tilt about which said container is emptied.

3. The container according to claim 2, wherein said cover comprises a top wall and side walls extending down from said top wall.

4. The container according to claim 3, wherein said cover is joined to said container by hinges, and said pivoting part is connected to said cover substantially in the middle of a side wall of the cover opposite from the hinges.

5. The container according to claim 1, wherein said cover comprises a top wall and side walls extending down from said top wall.

6. The container according to claim 5, wherein said top wall and said side walls comprise an interior volume, and said pivoting part further comprises an upper arm extending into said interior volume.

7. The container according to claim 5, wherein said cover is joined to said container by hinges, and said pivoting part is connected to said cover substantially in the middle of a side wall of the cover opposite from the hinges.

8. The container according to claim 7, wherein said top wall and said side walls comprise an interior volume, and said pivoting part further comprises an upper arm extending into said interior volume.

9. A container for collecting waste, comprising a body, a cover, articulated on said body, and a device for locking the cover on the body, said device. comprising:

a lug fixed on the body of the container;

a pivoting part pivotably mounted on the cover of said container, said pivoting part comprising a lower arm capable of engaging said lug when said cover is closed; and a means for unlocking said cover, said pivoting part moving between a locked position, in which said pivoting part keeps said cover in a closed position when said container is upright, and an unlocked position, in which said pivoting part releases said cover, said pivoting part moving from its locked position to its unlocked position using said means for unlocking and said pivoting part having an upper portion which is accessible from the inside of the container to move said pivoting part to the unlocked position and said cover and said body being free of structure that obstructs a downwardly facing surface of said upper portion of said pivoting part.

10. The container according to claim 9, wherein said means for unlocking comprises means for pushing back said pivoting part using a key.

11. The container according to claim 9, wherein said means for unlocking comprises means for actuating said lug using a key.

12. A container for collecting waste, comprising a cover and a device for locking the cover, said device comprising:

a pivoting part pivotably mounted on the cover of said container, said pivoting part comprising a lower arm capable of engaging a catch member when said cover is closed;

said pivoting part moving between a locked position, in which said pivoting part keeps said cover in a closed position when said container is upright, and an unlocked position, in which said pivoting part releases said cover, said pivoting part moving from its locked position to its unlocked position by force of gravity when said container is tilted, and said lower arm comprising three segments substantially comprising half of a hexagon whose concavity faces the interior of said container.

13. A container for collecting waste, comprising a cover and a device for locking the cover, said device comprising:

a pivoting part pivotably mounted on the cover of said container, said pivoting part comprising a lower arm capable of engaging a catch member when said cover is closed; and a protective frame in the interior of said container, said frame having a generally U-shaped cross-section and being fixed to an inside wall of the container on either side of said catch member, said frame defining a housing having an open top and an open bottom, said pivoting part moving between a locked position, in which said pivoting part keeps said cover in a closed position when said container is upright, and an unlocked position, in which said pivoting part releases said cover, said pivoting part moving from its locked position to its unlocked position by force of gravity when said container is tilted.

14. A container for collecting waste, comprising a cover and a device for locking the cover, said device comprising:

a pivoting part pivotably mounted on the cover of said container, said pivoting part comprising a lower arm capable of engaging a catch member when said cover is closed;

a means for unlocking said cover, and a protective frame in the interior of said container, said frame having a generally U-shaped cross-section and being fixed to an inside wall of the container on either side of said catch member, said frame defining a housing having an open top and an open bottom, said pivoting part moving between a locked position, in which said pivoting part keeps said cover in a closed position when said container is upright, and an unlocked position, in which said pivoting part releases said cover, said pivoting part moving from its locked position to its unlocked position using said means for unlocking.

* * * * *